US008226075B2

(12) United States Patent
Nelson

(10) Patent No.: US 8,226,075 B2
(45) Date of Patent: Jul. 24, 2012

(54) WORK-PIECE PIERCING CLAW JAWS FOR VISE

(76) Inventor: Kevin Dale Nelson, Havre de Grace, MD (US)

( * ) Notice: Subject to any disclaimer, the term of this patent is extended or adjusted under 35 U.S.C. 154(b) by 525 days.

(21) Appl. No.: 12/381,352

(22) Filed: Mar. 11, 2009

(65) Prior Publication Data

US 2010/0230884 A1 Sep. 16, 2010

(51) Int. Cl.
*B25B 1/24* (2006.01)

(52) U.S. Cl. ..... 269/265; 269/268

(58) Field of Classification Search ..... 269/265, 269/268, 270, 271, 282, 267, 257
See application file for complete search history.

(56) References Cited

U.S. PATENT DOCUMENTS 4,475,607 A * 10/1984 Haney ..... 269/218
4,928,938 A 5/1990 Ross
4,969,638 A * 11/1990 Yang ..... 269/265
5,078,372 A * 1/1992 Fitzpatrick ..... 269/282
6,062,553 A * 5/2000 Strehl ..... 269/268
6,152,435 A 11/2000 Snell
6,302,410 B1 * 10/2001 Wentworth et al. ..... 269/268
6,446,952 B1 9/2002 Sheehy, Jr.
6,530,567 B1 3/2003 Lang
2002/0056955 A1 5/2002 Klabo

* cited by examiner

*Primary Examiner* — Hadi Shakeri
(74) *Attorney, Agent, or Firm* — William S. Ramsey

(57) ABSTRACT

An exemplary embodiment providing one or more improvements includes removable faces for jaws in machine vise which are able to grip a work-piece with great stability, accuracy, and reproducibility. Embodiments include multiple gripping features so the gripping surface easily can be renewed by demounting and reversing a worn face to a new face. Embodiments include the ability to of the claw jaws to be mounted on any fixed or movable vise station to use the entire clamping range of the machine vise. Embodiments are disclosed which are used with round or curved as well as flat work-pieces. Embodiments also include flat surfaced claw jaws which may be used to grip a work-piece for secondary machining to remove indentations from the work-piece.

1 Claim, 9 Drawing Sheets

WORK-PIECE PIERCING CLAW JAWS FOR VISE

CROSS-REFERENCES TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

REFERENCE TO A "SEQUENCE LISTING," A TABLE, OR A COMPUTER PROGRAM LISTING APPENDIX

Not Applicable.

BACKGROUND

Embodiments in this disclosure relate to removable jaws for movable and fixed vise jaw stations which are used to immobilize a work-piece.

BACKGROUND

Description of Related Art Including Information Disclosed Under 37 CFR 1.97 AND 37 CFR 1.98

Embodiments of the present disclosure include vice jaws, termed claw jaws, which securely retain work-pieces otherwise known as "parts", or stock material in a machine vise by creating indentations along the bottom edge of the stock material with sharp gripping teeth. Indentations are created by gripping the work-piece with sufficient force to set the dents, vise pressure is then released from the work-piece, and is re-clamped again with significantly less force for minimal distortion of the work-piece. Such claw jaws are useful in first or secondary machining operations in rapidly and repeatedly securing work-pieces for prototype through production manufacturing of precision machined work-pieces using manual, automatic, or computerized machining centers. Embodiments may secure flat, rectangular, irregular, and round or curved work-pieces. Work-pieces clamped using embodiments will resist machining forces exerted from any direction. This is important in manufacturing processes using vertical, horizontal, or multi-axis machining centers with 3, 4, or 5 axis capabilities that process work-pieces on 5 or more sides in a single clamping. A machined work-piece can be reloaded into the same set of jaws for re-machining or multiple operations with repeatability accuracy down to 0.001 of an inch. Only an additional 1/16 inch minimum of excess holding material is required to secure the work-piece in the vise, depending upon jaw and tooth configuration, step depth, and work-piece material condition. These claw jaws also incorporate an advantage of standard flat vise jaws by providing a precision ground flat front surface for clamping finished work-pieces without damaging previously machined surfaces, useful for secondary operations.

U.S. Pat. No. 4,928,938 to Ross discloses a clamping device which uses cylindrical rods to hold the work piece.

U.S. Pat. No. 6,152,435 to Snell discloses a vise with collet jaws designed to hold cylindrical work material having varying diameters.

U.S. Pat. No. 6,446,952 to Sheehy discloses a vise with removable jaws which are retained by a screw.

U.S. Pat. No. 6,530,567 to Lang discloses a clamping device with coupling elements on the clamping surface which interact with recesses in the work piece.

U.S. Pub. Pat. Applic. 2002/0056955 by Klabo discloses a vise jaw assembly with a step and gripping pads on the vise jaws The discovered prior art do not provide the advantages of embodiments of the claw jaws which provide significant holding power while allowing the user to reduce clamping pressure exerted on the work-piece to minimize or eliminate work-piece distortion while maintaining the required holding force and requiring less excess work-piece holding material for securing the work-piece in a machine vise to enable reliable, accurate, and repeatable clamping. The prior art do not have sharp teeth for penetrating deep into the work-piece allowing for decreased clamping pressure after indentations are set. The prior art do not provide any additional clamping surfaces incorporated onto the same jaw; these claw jaws provide six clamping surfaces; four surfaces with an array of sharp teeth above a step to bite into or grip the bottom edge of a work-piece and two precision ground flat faces for clamping on finished machined surfaces or larger smooth surfaces of stock work-pieces. The prior art do not allow the user to reverse the jaw to additional clamping surfaces to use the entire range of the machine vise. The prior art do not allow the user to flip the jaws to expose a new or different tooth array or clamping surface. The prior art do not provide accessory holes integrated into both ends of the jaws to allow the user to position work stops in multiple places as deemed necessary to provide the repeatability accuracy.

The foregoing examples of the related art and limitations related therewith are intended to be illustrative and not exclusive. Other limitations of the related art will become apparent to those of skill in the art upon a reading of the specification and a study of the drawings.

BRIEF SUMMARY

The following embodiments and aspects thereof are described and illustrated in conjunction with systems, tool, and methods which are meant to be exemplary and illustrative, not limiting in scope. In various embodiments, one or more of the above described problems have been reduced or eliminated, while other embodiments are directed to other improvements.

Embodiments include jaws, termed claw jaws, which are attached to fixed jaw stations and movable jaw stations of machine vises which secure a work-piece for initial or further machining. Embodiments comprise a rectangular slab having flat front, rear, top, and bottom, and left and right surfaces. In addition, there is a work-piece gripper comprised of a step, a step floor, a step back relief, and an array of sharp teeth. The step is located at the intersection of the front or rear surfaces with the top or bottom surfaces of a claw jaw, respectively. An array of sharp teeth is located in front of the step back relief, the common centerline through the apex of the array of the teeth being aligned parallel to the top surface. The array comprises a multiplicity of adjacent pyramid-shaped teeth with a tangent radius connecting the left and right surfaces of adjacent teeth for strengthening the entire array. The front view of a single tooth in the array comprises four angular planes referred to as: lower, upper, left, and right surfaces that intersect to form the apex of the tooth which has a small tangent radius to strengthen the point. The lower surfaces of the teeth intersect the step floor at the undercut relief with a tangent radius to strengthen the entire array. The lower and upper surface of the teeth intersect at the apex of the teeth and lie on the same angular planes as the lower and upper surfaces of adjacent teeth.

In a second embodiment work-piece gripper comprised of a step, a step floor, a step back relief, and an array of sharp teeth having the appearance of a sine-wave like curve when viewed from the top. This appearance is created by an array of alternating tangential radii forming the curved shape of the teeth. This array of curved sharp teeth is located in front of the step back relief, the common centerline through the apex of the array of the teeth being aligned parallel to the top surface. The array comprises a multiplicity of adjacent curved teeth with tangent radii connecting the left and right surfaces of adjacent teeth for strengthening the entire array. The front view of a single tooth in the array comprises two angular planes referred to as: lower and upper and two curved edges referred to as: left and right; these surfaces intersect to form the apex of the tooth with the curved edges strengthening the clamping surface. The lower surfaces of the teeth intersect the step floor at the undercut relief with a tangent radius to strengthen the entire array. The lower and upper angular surface of the teeth intersect at the apex of the teeth and lie on the same angular planes as the lower and upper surfaces of adjacent teeth. The teeth have a sine wave like curved outline resulting from intersecting the left and right edges of tangential radii. The intersection of the upper, lower, left, and right surfaces form a sharp edge with a curved profile.

Embodiments also include third embodiment claw jaws which are attached to fixed jaw stations and movable jaw stations of a machine vise which secures a cylindrical work-piece for initial or further machining. Third embodiment claw jaws comprise a rectangular slab having flat front, rear, top, and bottom, and left and right surfaces with a partial cylindrical cavity at the intersection of the top and front surfaces. In addition, there is a work-piece gripper comprised a step, a step floor, a step back relief. The step is located within the partial cylindrical cavity at the intersection of the front surface with the top or bottom surfaces of a claw jaw, respectively. An array of sharp teeth is located near the top of the step back relief, the array being aligned parallel to the top or bottom surfaces. The array comprises a multiplicity of adjacent pyramid-shaped teeth as described for the first embodiment claw jaw or array comprises a multiplicity of adjacent sine-wave like curved teeth as described for the second embodiment claw jaw.

In addition to the exemplary aspects and embodiments described above, further aspects and embodiments will become apparent by reference to the drawings and by study of the following descriptions.

DETAILED DESCRIPTION

Figure 1:
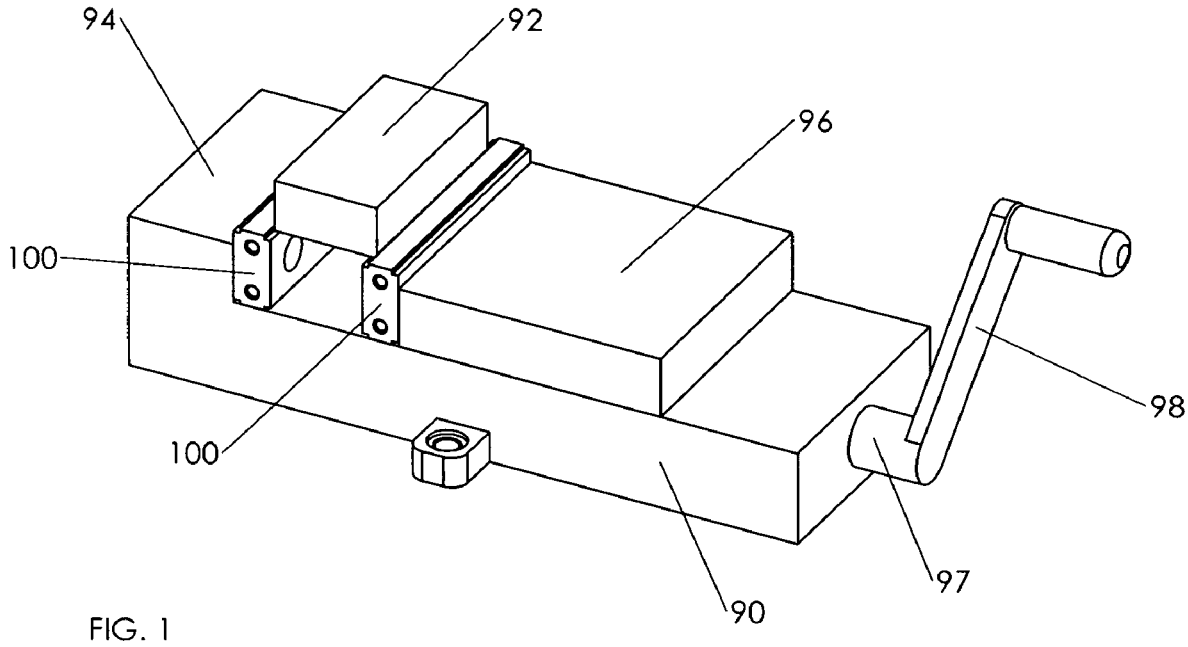
FIG. 1 is a perspective view of a flat or rectangular work-piece held by first embodiment claw jaws attached to the fixed jaw station and the movable jaw station of a machine vise.

FIG. 1 is a perspective view of a flat or rectangular work-piece held by first embodiment claw jaws attached to the fixed jaw station and the movable jaw station of a machine vise. Visible in FIG. 1 is a machine vise 90, a fixed jaw station 94, a movable jaw station 96, a screw 97 for moving the movable jaw station, and a handle 98 for rotating the screw. First embodiment claw jaws 100 are attached to the fixed jaw station and the movable jaw station. A work-piece with flat surfaces 92 is retained between the claw jaws.

Figure 2:
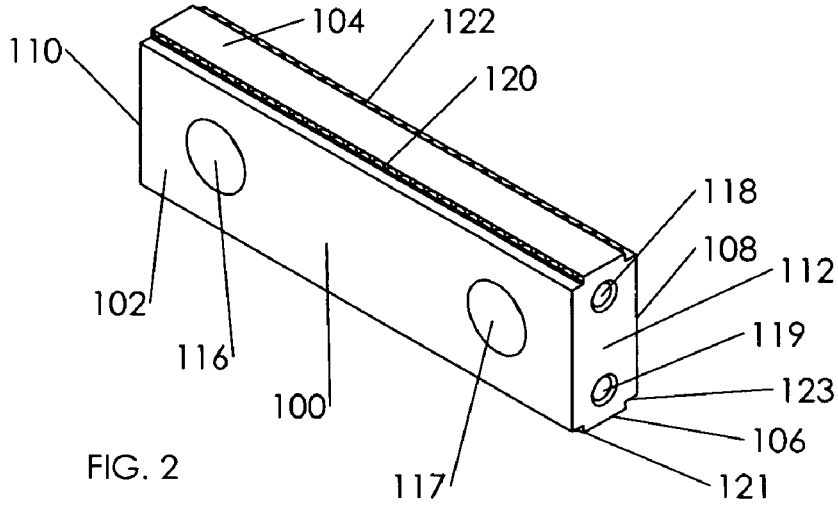
FIG. 2 is a perspective view of a first embodiment claw jaw.

FIG. 2 is a perspective view of a first embodiment claw jaw 100 which has the general shape of a rectangular slab. Visible in FIG. 2 is the front surface 102, top surface 104, and right end surface 112. Also indicated in FIG. 2 is the back surface 108, bottom surface 106, and left end surface 110. Visible in FIG. 2 is the left attachment hole 116 and right attachment hole 117. The attachment holes are used to securely attach a claw jaw to a fixed or movable jaw position in a machine vise using bolts or cap screws. Also visible in FIG. 2 is an upper threaded accessory hole 118 and a lower threaded accessory hole 119. The accessory holes are used in conjunction with stops (not shown in FIG. 2) to allow repeatable securing of work-pieces in the jaws of the machine vise. For example, a washer which extends beyond the front surface 102 may be attached to the claw jaw using a fastener threaded into accessory hole 118. Work-pieces may be reproducibly oriented in the vise by placing one surface of the work-piece abutting the extending portion of the washer. A front upper work-piece gripper 120 (shown in more detail in FIGS. 6 and 7) and a back upper work-piece gripper 122 are also visible. The step for a front lower work-piece gripper 121 and a back lower work-piece gripper 123 are also shown. In embodiments the front surface 102 and the back surface 108 are hardened, precision ground flat surfaces. Such surfaces are capable of clamping smooth stock or previously machined surfaces.

The purpose of multiple work-piece grippers on a single claw jaw is to allow reversibility to expose a new work-piece gripper when the teeth of the first-used gripper become worn and dulled through use, to introduce internal clamping applications using standard machine vises, and to utilize the entire working range of the machine vise using external and internal clamping applications, therefore increasing the size range of work pieces that may be gripped in the vise and allowing flexibility in clamping methods expanding the end users' machining capabilities. Alternatively the claw jaws allow versatility by incorporating one or more variations of embodiments of the work-piece gripper that may be on one claw jaw; making it possible to change the claw jaw to match the size or condition of the work-piece being retained by the vise.

Figure 3:
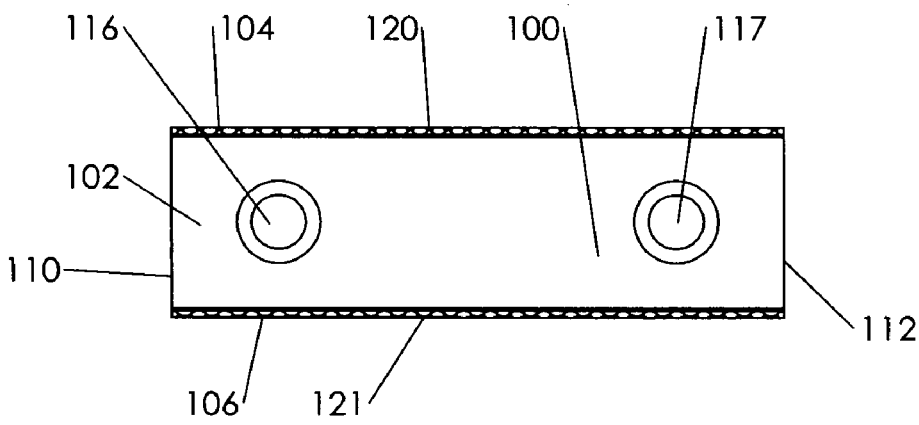
FIG. 3 is a front view of a first embodiment claw jaw.

FIG. 3 is a front view of a first embodiment claw jaw 100. Visible in FIG. 3 is the front surface 102, left end surface 110, right end surface 112, top surface 104 and bottom surface 106. Also visible is the left attachment hole 116, the right attachment hole 117, upper front work-piece gripper 120, and front lower work-piece gripper 121.

Figure 4:
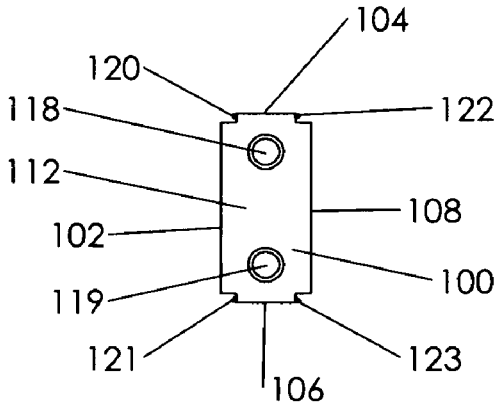
FIG. 4 is an end view of a first embodiment claw jaw.

FIG. 4 is an end view of a first embodiment claw jaw 100. Visible in FIG. 4 is right end surface 112, and the location of the front surface 102, back surface 108, top surface 104, and bottom surface 106 is indicated. The upper threaded accessory hole 118 and lower threaded accessory hole 119 are shown. Also depicted are end views of the front upper work-piece gripper 120, front lower work-piece gripper 121, back upper work-piece gripper 122, and back lower work-piece gripper 123.

Figure 5:
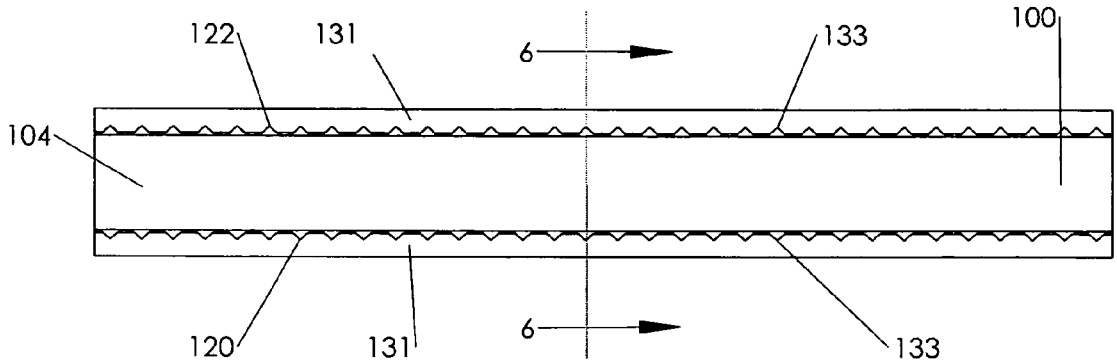
FIG. 5 is a top view of a first embodiment claw jaw.

FIG. 5 is a top view of a first embodiment claw jaw 100 with first embodiment work-piece grippers 120 and 122. Visible in FIG. 5 is the top surface 104, front upper first embodiment work-piece gripper 120, and rear upper first embodiment work-piece gripper 122. Three components of the first embodiment work-piece gripper; the array of sharp pointed teeth 133, the step floor 131, and the step back relief 132 are also visible in FIG. 5.

Figure 6:
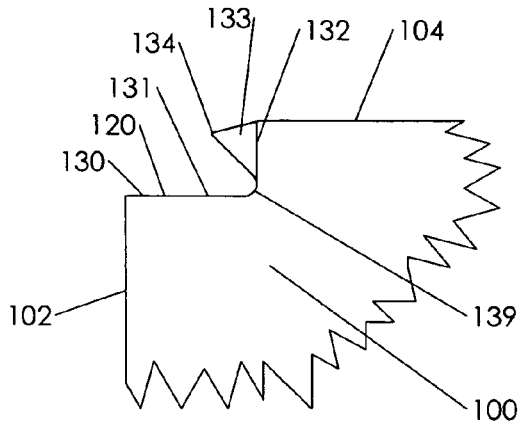
FIG. 6 is a partial cross-section view taken at line 6-6 of FIG. 5 showing details of a first embodiment work-piece gripper.

FIG. 6 is a partial cross-section view taken at line 6-6 of FIG. 5 showing details of a first embodiment work-piece gripper. First embodiment work-piece gripper 120 is located at the intersection of the front surface 102 and top surface 104. The work-piece gripper is comprised of a step 130, comprising a step floor 131, and a step back relief 132 approximately perpendicular to the step floor, and an array of sharp pointed teeth 134 located in front of the step back relief 132, and a common centerline through the apex of the array of pointed teeth 134 being aligned parallel to the top surface 104.

An undercut relief 139 is located at the intersection of the step floor 131 and step back relief 132. In embodiments the undercut relief 139 is a partial arc with a radius of approximately 0.015 of an inch, which serves to strengthen the intersection between the step floor 131 and tooth bottom surface 136 (shown in FIG. 7). The apex or point of the teeth 134 is located at a point closer to the top surface 104 than to the step floor 131.

The width of the step floor 131 must be wide enough to insure the work-piece is supported by a pair of claw jaws. The width of the step floor 131 should be minimal in order to avoid the possibility of interfering with operations on the work-piece. For example, the step floor should not be so wide that drilling through the work-piece will involve drilling into the step floor. In embodiments, the step floor is approximately 0.154 of an inch and will vary depending upon specific application. In embodiments, the step floor is about 0.060 inch to about 0.300 inch wide.

Figure 7:
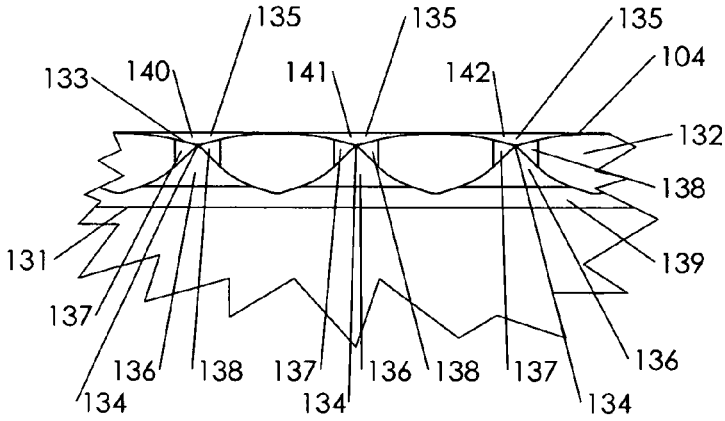
FIG. 7 is a front view of a portion of an array of teeth showing three teeth on a first embodiment work-piece gripper.

FIG. 7 is a front view of a portion of an array of pointed teeth 133 showing three example pointed teeth 140, 141, 142 located on the step back relief 132 between the top surface 104 and the step floor 131. The apex or point 134 of the teeth is closer to the top surface 104 than to the step floor 131. The pointed teeth 140, 141, 142 approximate and may be thought of as pyramids each with an apex or point 134, tooth top surface 135, tooth bottom surface 136, tooth left surface 137, and tooth right surface 138. In the pyramid model the surface area of the pointed tooth top surface 135 is less than or equal to the surface area of the tooth bottom surface 136. In an array of pointed teeth of the first embodiment claw jaw the angle between the tooth right surface 138 of one tooth 140 and the tooth left surface 137 of adjacent tooth 141 approximates 90°. Although not shown in FIG. 7, an undercut web is found at the intersection between adjacent teeth, for example at the intersection between the right surface 138 of tooth 140 and left surface 137 of tooth 141. The undercut web is similar to the undercut relief 139 depicted in FIG. 6.

Figure 8:
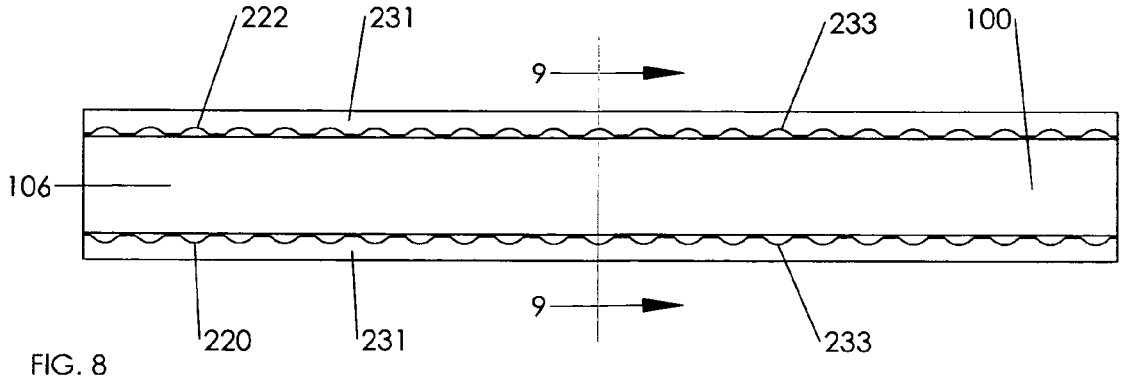
FIG. 8 is a top view of a second embodiment work-piece gripper located on a first embodiment claw jaw.

FIG. 8 is a top view of second embodiment work-piece grippers 220 and 222 on a first embodiment claw jaw 100. The second embodiment work-piece gripper differs from the first embodiment in the structure of the teeth. The teeth of the first embodiment viewed from the above are pointed; the teeth of the second embodiment viewed from above are curved.

Visible in FIG. 8 is the claw jaw top surface 106, front upper second embodiment work-piece gripper 220, and rear upper second embodiment work-piece gripper 222. Two components of the second embodiment work-piece gripper, the array of curved teeth 233 and the step floor 231 are also visible in FIG. 8.

Figure 9:
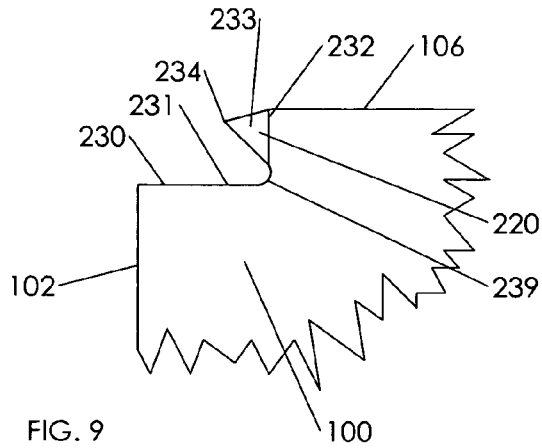
FIG. 9 is a partial cross-section view taken at line 9-9 of FIG. 8 showing details of a second embodiment work-piece gripper.

FIG. 9 is a partial cross-section view taken at line 9-9 of FIG. 8 showing details of a second embodiment work piece work-piece gripper on a first embodiment claw jaw 100. Second embodiment work-piece gripper 220 is located at the intersection of the front surface 102 and top surface 106. The work-piece gripper is comprised of a step 230, comprising a step floor 231, and a step back relief 232 approximately perpendicular to the step floor, and an array of curved sharp teeth 234 located in front of the step back relief 232, and a common centerline through the apex of the array of teeth 234 being aligned parallel to the top surface 106. An undercut relief 239 is located at the intersection of the step floor 231 and step back relief 232. In embodiments the undercut relief 239 is a partial arc with radius of approximately 0.015 of an inch, which serves to strengthen the intersection between step floor 231 and tooth bottom surface 236 (shown in FIG. 10). In embodiments the undercut relief is a partial arc with radius of approximately 0.002 inches to approximately 0.030 inches. The apex of the teeth 234 is located at a point closer to the top surface 106 than to the step floor 231.

The width of the step floor 231 must be wide enough to insure the work-piece is supported by the claw jaw. The width of the step floor 231 should be minimal in order to avoid the possibility of interfering with operations on the work-piece. For example, the step floor should not be so wide that drilling through the work-piece will involve drilling into the step claw. In embodiments, the step floor is approximately 0.154 of an inch wide. In embodiments the step floor will very depending upon specific application. In embodiments the step floor is approximately 0.075 inch to approximately 0.300 inches wide.

Figure 10:
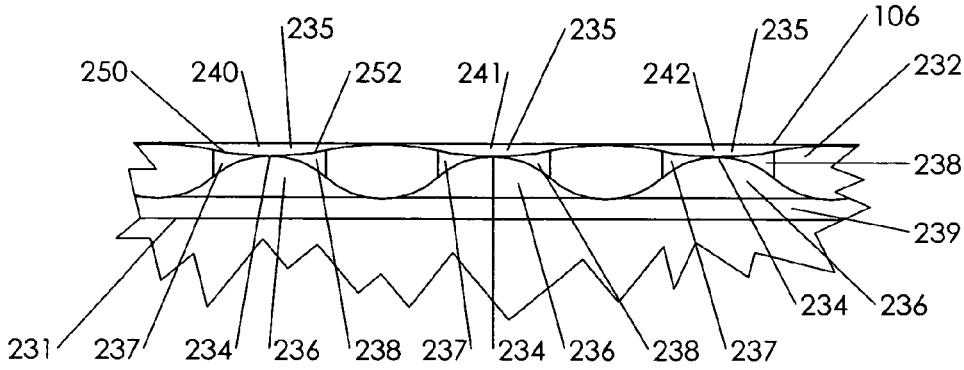
FIG. 10 is a front view of a portion of an array of teeth showing three teeth on a second embodiment work-piece gripper.

FIG. 10 is a front view of a portion of an array of curved teeth 234 showing three example curved teeth 240, 241, 242 located on the step back relief 232 between the top surface 106 and the step floor 231. The curved teeth 240, 241, and 242 have the appearance of a sine-wave like curve when viewed from the top surface of the claw jaw. The curved teeth 240, 241, 242 approximate and may be thought of pyramids each with a flat tooth top surface 235 with curved edges which form the appearance of an array of curved teeth when viewed from the top surface of the claw jaw. In curved tooth 240, for example, the left curved edge 250 of the tooth top surface 235 is formed by the intersection of the tooth top surface 235 with the curved tooth left surface 237, and the right curved edge 252 of the tooth top surface 235 is formed by the intersection of the tooth top surface 235 with the curved tooth left surface 238. The tooth bottom surface 236 is angular but flat. In the pyramid model the surface area of the tooth top surface 235 is less than or equal to the surface area of the tooth bottom surface 236. The apex 234 of each tooth is the point of intersection of the bottom and top angular surfaces and left and right curved edges of the tooth. The apex 234 is closer to the top 106 of the claw jaw than to the step floor 231. Although not shown in FIG. 10, an undercut web is found at the intersection between adjacent teeth, for example at the intersection between the right surface 238 of tooth 240 and left surface 237 of tooth 241. The undercut web between the curved teeth is similar to the undercut relief 239 depicted in FIG. 9, and serves to strengthen the area between the teeth of the entire array.

In embodiments the plane of the top surface of a tooth is at an angle of about 15° below the plane of the top surface of the claw jaw. This angle may vary from about 0° to about 45° below the plane of the top surface of the claw jaw. Relatively smaller angles are used with work-pieces of relatively softer material. Relatively larger angles are used with work-pieces of relatively harder material. For example, teeth with a relatively smaller angle of 15° would be damaged if used with a relatively hard work-piece, such as a work-piece made of tool steel. Claw jaws for use with such harder work-pieces would have an angle up to about 45°. These comments concerning the angle of the top surface of a tooth apply to any embodiments of the work-piece grippers.

Figure 11:
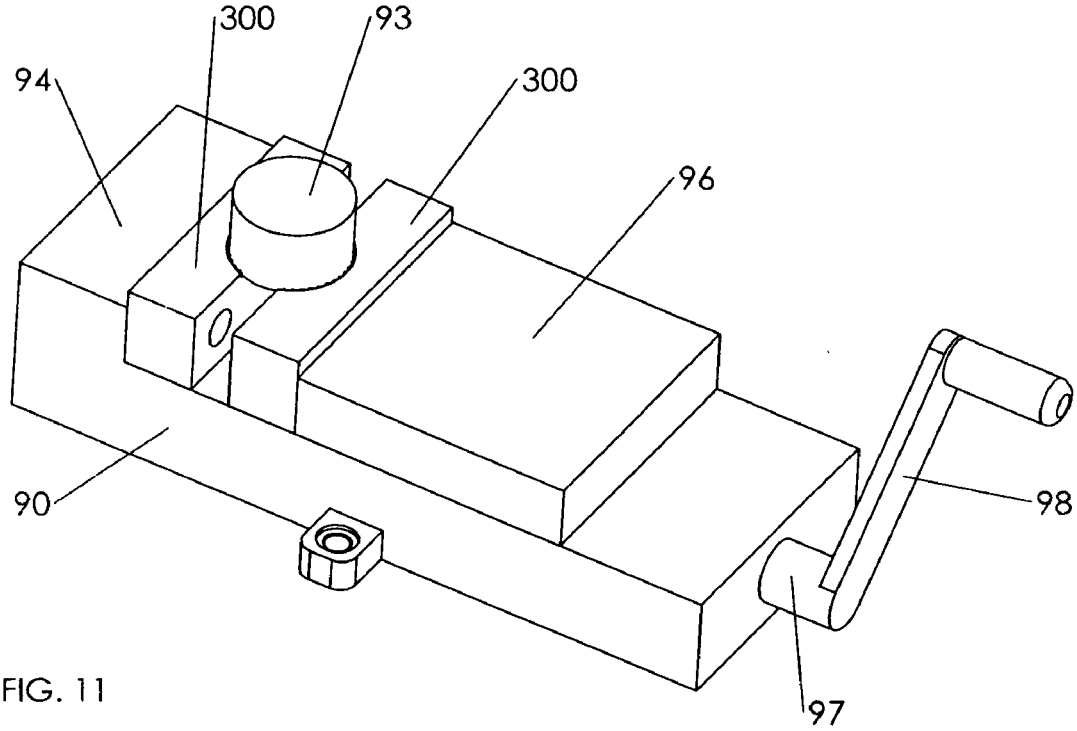
FIG. 11 is a perspective view of a round work-piece held by third embodiment claw jaws attached to the fixed jaw station and the movable jaw station of a machine vise.

FIG. 11 is a perspective view of a round or curved work-piece held by third embodiment claw jaws attached to the fixed jaw station and the movable jaw station of a machine vise. The elements of the machine vise 90 visible in FIG. 1 are also visible in FIG. 11, a fixed jaw station 94, a movable jaw station 96, a screw 97 for moving the movable jaw station, and a handle 98 for rotating the screw. Third embodiment claw jaws 300 having a partial cylindrical cavity in the top surfaces are attached to the fixed jaw station and the movable jaw station. A work-piece with curved surfaces 93 is retained between the second embodiment claw jaws.

Figure 12:
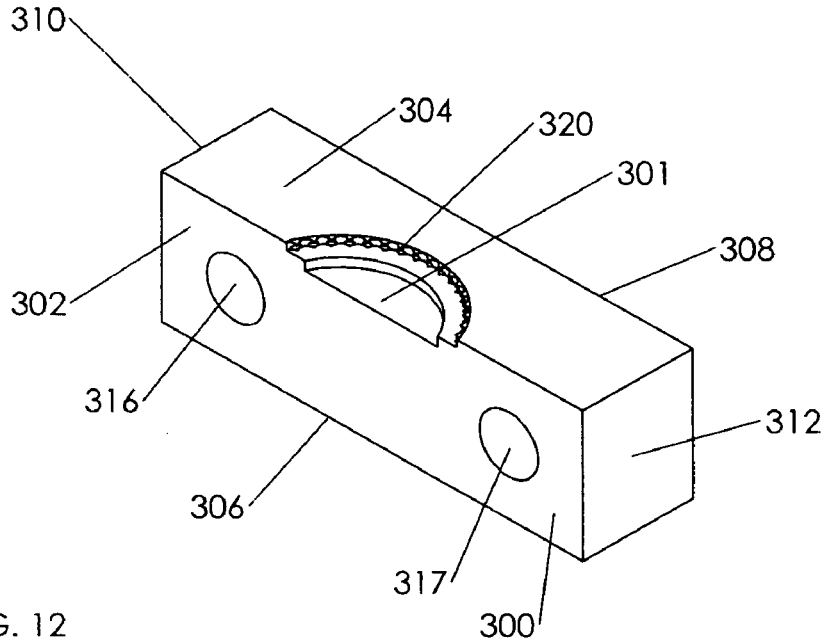
FIG. 12 is a perspective view of a third embodiment claw jaw.

FIG. 12 is a perspective view of a third embodiment claw jaw 300 which has the general shape of a rectangular slab with a partial cylindrical cavity in the top surface. Visible in FIG. 12 is the front surface 302, top surface 304, partial cylindrical cavity 301 in the top surface, and right end surface 312. Also indicated (but not visible) in FIG. 12 are the back surface 308, bottom surface 306, and left end surface 310. Visible in FIG. 12 is the left attachment hole 316 and right attachment hole 317. The attachment holes are used to securely attach a third embodiment claw jaw to a fixed or movable jaw position in a machine vise using bolts or cap screws. Also visible in FIG. 12 is an upper third embodiment work-piece gripper 320 (more detail on first embodiment work-piece grippers appears in FIGS. 6, 7, and 8) in the top surface 304. Not visible in FIG. 12 is an optional lower work-piece gripper (more detail on second embodiment work-piece grippers appears in FIGS. 8, 9, and 10) located in the bottom surface 306 (not visible in FIG. 12). The upper and lower work-grippers may be of different dimensions for use with a variety of different size work-pieces, or the grippers may be of similar size. After one gripper is worn or damaged, extending the useful life of the claw jaw is possible by reversing or flipping the position of the claw jaw on the machine vise jaw stations, exposing a new set of grippers.

Figure 13:
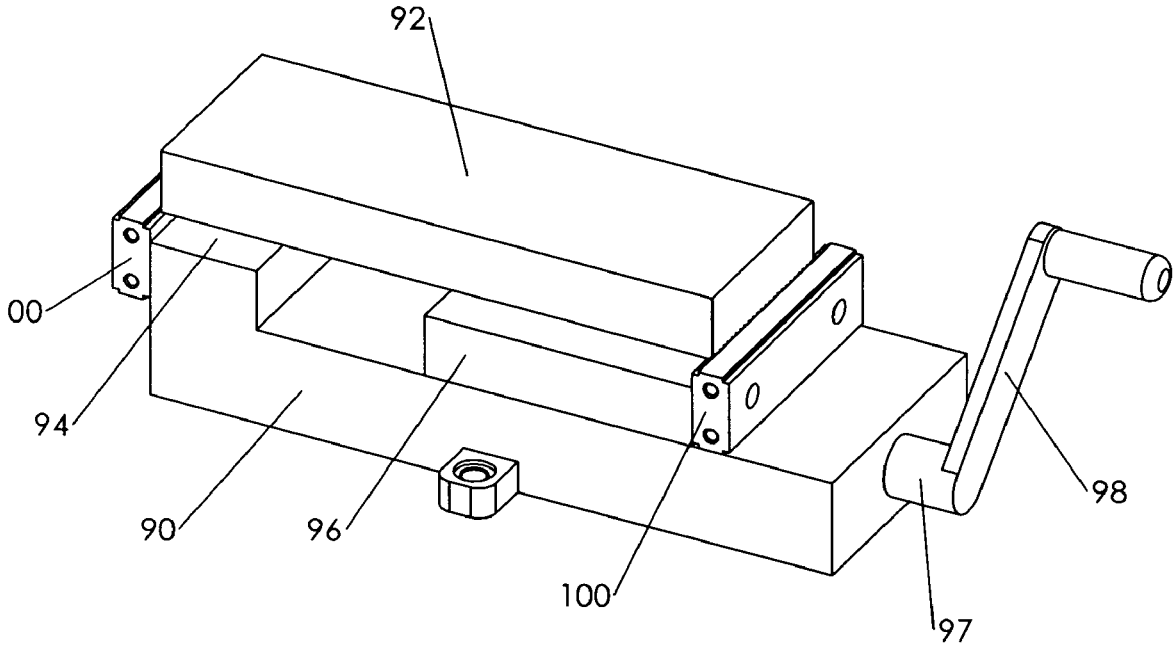
FIG. 13 is a perspective view of a large flat or rectangular work-piece held by first embodiment claw jaws attached to the back of the fixed jaw station and to the back of the movable jaw station of a machine vise, showing the versatility and reversibility of the first and second embodiment claw jaws.

FIG. 13 is a perspective view of a flat work-piece held by first embodiment claw jaws attached to the back of the fixed jaw station and to the back of the movable jaw station of a machine vise. The elements of FIG. 13 are the same as the elements of FIG. 1. A machine vise using the configuration in FIG. 13 is capable of securing relatively larger work-pieces compared to FIG. 1. The claw jaws enable the user to cover the entire range of the machine vise by reversing the jaws from the standard inside clamping positions as shown in FIG. 1, to the outside clamping position as shown in FIG. 13, or any combination in between (entire range shown in FIG. 1, FIG. 13, FIG. 14, & FIG. 15) to hold different size work-pieces utilizing the entire clamping range of the machine vise therefore expanding the end users' holding machining capabilities.

Figure 14:
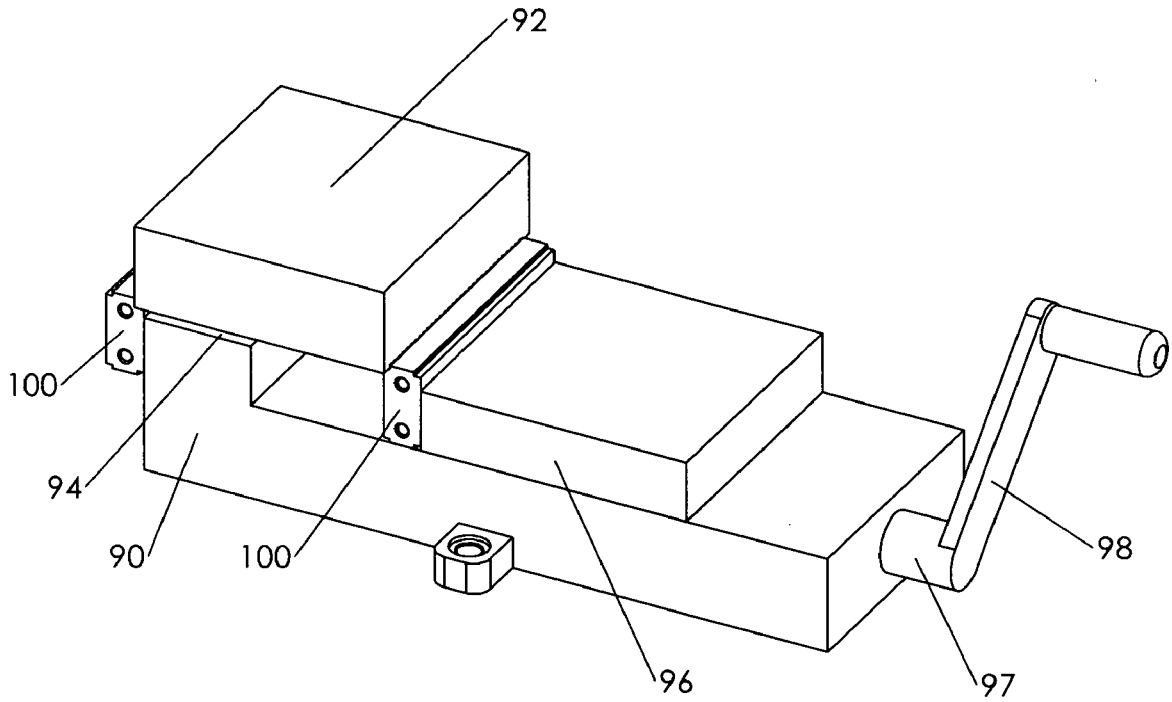
FIG. 14 is a perspective view of a flat or rectangular work-piece held by first embodiment claw jaws attached to the back of the fixed jaw station and to the front of the movable jaw station of a machine vise.

FIG. 14 is a perspective view of a flat work-piece held by first embodiment claw jaws attached to the back of the fixed jaw station and to the front of the movable jaw station of a machine vise. The elements of FIG. 14 are the same as the elements of FIG. 1. A machine vise using the configuration in FIG. 14 is capable of securing relatively larger work-pieces compared to FIG. 1. The claw jaws enable the user to cover the entire range of the machine vise by reversing the jaws from the standard inside clamping positions as shown in FIG. 1, to a combination outside and inside clamping position as shown in FIG. 14.

Figure 15:
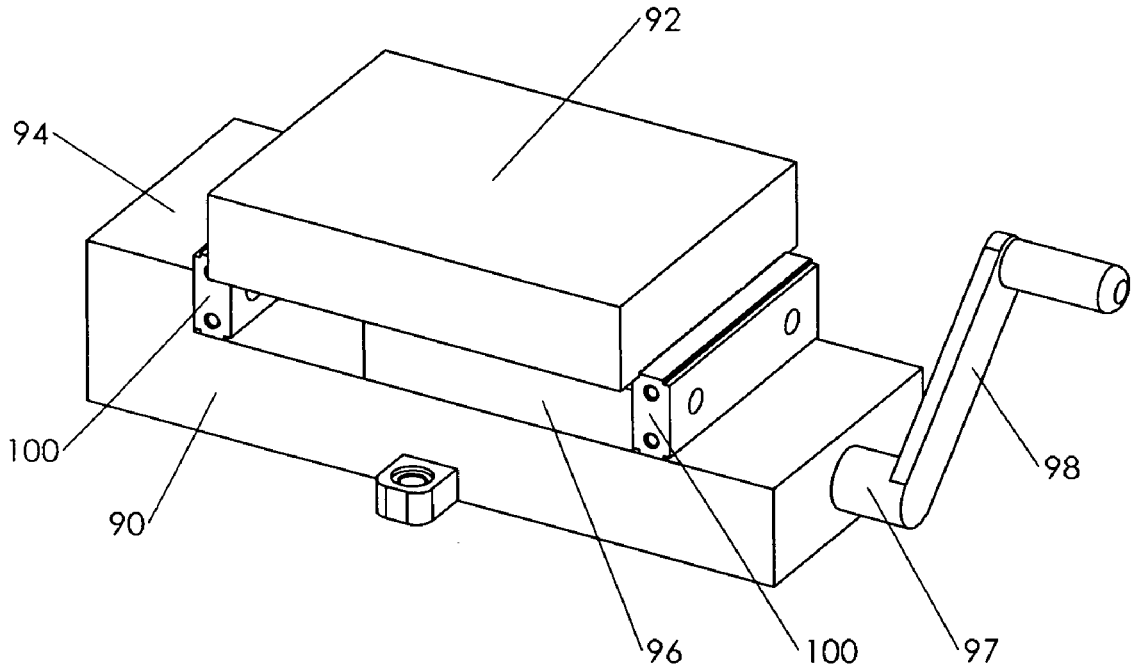
FIG. 15 is a perspective view of a flat or rectangular work-piece held by first embodiment claw jaws attached to the front of the fixed jaw station and to the back of the movable jaw station of a machine vise.

FIG. 15 is a perspective view of a flat work-piece held by first embodiment claw jaws attached to the front of the fixed jaw station and to the back of the movable jaw station of a machine vise. The elements of FIG. 15 are the same as the elements of FIG. 1. A machine vise using the configuration in FIG. 15 is capable of securing relatively larger work-pieces compared to FIG. 1. The claw jaws enable the user to cover the entire range of the machine vise by reversing the jaws from the standard inside clamping positions as shown in FIG. 1, to a combination inside and outside clamping position as shown in FIG. 15.

Figure 16:
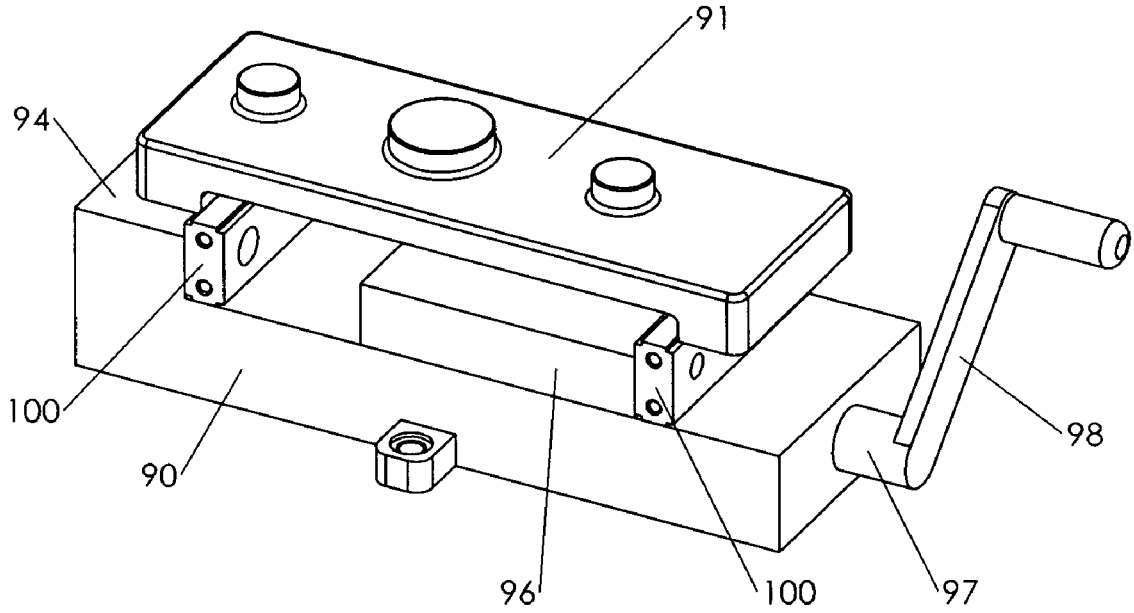
FIG. 16 is a perspective view of a flat or rectangular work-piece held internally by first embodiment claw jaws attached to the front of the fixed jaw station and to the back of the movable jaw station of a machine vise

FIG. 16 is a perspective view of a cast or forged work-piece 91 clamped internally for initial machining or could also represent a previously machined work-piece 91 being re-clamped for further machining on a secondary operation held by first embodiment claw jaws attached to the front of the fixed jaw station and to the back of the movable jaw station of a machine vise (also shown in FIG. 15). The elements of FIG. 16 are the same as the elements of FIG. 1. A machine vise using the configuration in FIG. 16 is capable of securing relatively larger work-pieces compared to FIG. 1. The claw jaws also enable the user to clamp parts internally over the entire clamping range of the vise not just externally. Most other jaws are designed exclusively for external clamping applications only. Shown in FIG. 16 is another useful advantage of being able to reverse the claw jaws and shows the importance of having multiple grippers on one set of claw jaws. In FIG. 16 the work-piece being clamped on the inside, instead of the normal outside clamping method as shown in FIG. 1, FIG. 13, FIG. 14, & FIG. 15.

It is specifically contemplated that any embodiment work-piece gripper can be used with any embodiment claw jaw.

A pair of claw jaws are installed on a machine vise by attachment of one claw jaw to a fixed jaw station and the other to a movable jaw station. Any suitable reversible means of attachment may be used, such as socket head cap screws, bolts, or other fasteners which are inserted through counter bored holes in the claw jaw. The fasteners interact with threaded holes in the jaw stations. Threading fasteners through the attachment holes in the claw jaws into the jaw stations and tightening them will secure the jaws to the jaw stations of the machine vise.

The movable jaw station allows adjustability to make use of the entire clamping range of the vise. A work-piece stop is typically mounted to the side of the claw jaw and is used to locate work-pieces for repeatable setting within the machine vise for repetitive production applications.

In clamping a work-piece using a machine vise with installed claw jaws, the movable jaw station is rough adjusted to allow the work-piece to sit evenly on the step floor of both claw jaws. Generally, the work-piece will be loaded on the steps of the claw jaws and located against a work stop on either edge of the work-piece. The vise is then closed on the work-piece and clamped by the vise screw which moves the movable jaw station toward the stationary or fixed jaw station. The screw is activated by hand using a handle or hydraulically activated by a hand or foot switch. The operator clamps the vise with increasing pressure until the teeth of the claw jaws penetrate the work-piece sufficiently enough to form indentations in the work-piece. The clamping pressure required to set these indentations in the work-piece vary depending on the type and grade of the subject work-piece material. Generally, clamping pressure ranges from 50 to 100 foot pounds when applied by a manual torque wrench to a screw activated vise. Once the indentations are set into the work-piece, the clamping pressure can be significantly reduced to a much lower range to minimize clamping distortion of the work-piece. The clamping pressure is typically reduced between 5 to 50 foot pounds for machining of the work-piece, depending on the amount of allowable distortion of the finished work-piece.

The use of claw jaws typically result in indentations of approximately 0.050 of an inch deep. In many work-pieces, such as castings, forgings, or flame cut shapes such indentations are of little consequence and may be ignored. In other work-pieces, subsequent operations will remove the dented areas. Embodiment claw jaws with a hardened, precision ground flat front or back surface may be used to clamp smooth stock or smooth surfaces of previously machined stock. This allows the user to secure the stock for machine removal of the indentations without the need for changing the vise jaws.

Use of embodiment claw jaws allows greatly reduced clamping pressure during machining compared to conventional jaws while using significantly less excess material for clamping purposes. Without depending on this description of the operation of the claw jaws, it is believed the teeth of the claw jaws penetrate the work-piece and form recesses or indentation that project displaced material downward toward the step and into the undercut area, upward to the bottom surface of the teeth, and outward into the recessed web between the teeth above the step of the jaws. This displacement results in the work-piece being held with extreme force with very little clamping pressure compared to conventional methods. The use of these claw jaws provide the user with many benefits including: using less excess stock holding material, quick and secure clamping, work-piece distortion is kept to a minimum, work-piece accuracy improvements, elimination of preparatory operations, minimizing secondary operations, eliminating additional operations, and provides the user the ability to increase machining parameters to reduce cycle times and to increase profit margins.

Embodiment claw jaws hold the work-piece more firmly with much less distortion than other vise jaws while requiring less excess work-piece material for the vise to hold onto in order to secure the work-piece. Work-pieces thusly clamped will resist machining forces exerted from any direction. This is especially advantageous in manufacturing processes using vertical, horizontal, or multi-axis machining centers with 3, 4, or 5 axis capabilities which process parts on 5 or more sides in a single clamping. Once the work-piece has been machined and removed from the vise, it can also be reloaded into the same set of claw jaws with accuracies down to 0.001 of an inch, a capability very useful for re-machining on subsequent operations.

Embodiments of claw jaws are manufactured from any suitable hard, strong, ductile material which is harder than the work-piece material to be secured in the vise. Generally, case hardening or heat treatable carbon and alloy steels are used to manufacture claw jaws used for ductile materials such as aluminum, brass, plastics, and low carbon steels. Tool steels are used to manufacture claw jaws for use with medium and high carbon steels, alloy steels, stainless steels and tool steels up to 40 Hrc (Rockwell hardness scale). Embodiments are specifically contemplated which include carbide tipped teeth or replaceable tool steel teeth configurations to optimize the use of claw jaws with exotic work-piece materials and hydraulic vise applications.

The third embodiment claw jaws differ from the first embodiment in that the front side is not flat but has a partial cylindrical void. The third embodiment jaws are used to grip round or curved work-pieces.

While a number of exemplary aspects and embodiments have been discussed above, those of skill in the art will recognize certain modifications, permutations, additions, and sub-combinations thereof. It is therefore intended that the following appended claims and claims hereafter introduced are interpreted to include all such modifications, permutations, additions, and sub-combinations as are within their true spirit and scope.

I claim:

1. A claw jaw for a machine vise which secures a work-piece for machining comprising:

a rectangular slab having a front and a rear surface, and flat top, bottom, left and right surfaces, a work-piece gripper, the work-piece gripper comprising, a step comprising a step floor and step back relief, the step located at the intersection of the front or rear surfaces and the top or bottom surfaces, respectively, and an array of teeth located on the step back relief, the array aligned parallel to the plane of the top surface, the array comprising a multiplicity of pyramid-shaped teeth arranged in a line, each tooth in said array comprising a pyramid with bottom, lower, upper, left, and right surfaces, the bottom surface of the tooth attached to the step back relief, and the surface area of the upper surface of the tooth smaller than or equal to the surface area of the lower surface of the tooth, and means for reversibly attaching the claw jaw to a fixed jaw station or a moveable jaw section of a machine vise, wherein the angle between the plane of the upper surface of the tooth is at an angle of approximately 15° to the plane of the top surface of the claw jaw, and the angle between the plane of the lower side of the tooth is at an angle of approximately 45° to the plane of the step back relief.

* * * * *